US008391533B2

(12) United States Patent
Sim et al.

(10) Patent No.: US 8,391,533 B2
(45) Date of Patent: Mar. 5, 2013

(54) EAR BUD EARPHONE WITH VARIABLE NOISE ISOLATION, A CUSHION FOR AN EAR BUD EARPHONE AND A CORRESPONDING METHOD

(75) Inventors: Wong Hoo Sim, Singapore (SG); Fong Lin Leong, Singapore (SG); Thean Kuie Christopher Chang, Singapore (SG); Boon Cheong Raymond Ng, Singapore (SG); Shin Huei Eric Seow, Singapore (SG)

(73) Assignee: Creative Technology Ltd, Singapore (SG)

( * ) Notice: Subject to any disclaimer, the term of this patent is extended or adjusted under 35 U.S.C. 154(b) by 291 days.

(21) Appl. No.: 12/744,303

(22) PCT Filed: Oct. 20, 2008

(86) PCT No.: PCT/SG2008/000405

§ 371 (c)(1),
(2), (4) Date: May 21, 2010

(87) PCT Pub. No.: WO2009/067085

PCT Pub. Date: May 28, 2009

(65) Prior Publication Data

US 2010/0246878 A1 Sep. 30, 2010

(30) Foreign Application Priority Data

Nov. 22, 2007 (SG) ..... 200717998-9

(51) Int. Cl.
*H04R 25/00* (2006.01)
*H04R 1/02* (2006.01)

(52) U.S. Cl. ..... 381/380; 381/87; 381/386; 381/395

(58) Field of Classification Search ..... 381/380
See application file for complete search history.

(56) References Cited

U.S. PATENT DOCUMENTS

| | | | | |
|---|---|---|---|---|
| 4,041,256 | A | 8/1977 | Ohta et al. | |
| 4,870,688 | A * | 9/1989 | Voroba et al. | 381/60 |
| 5,357,585 | A | 10/1994 | Kumar | |
| 5,949,896 | A * | 9/1999 | Nageno et al. | 381/328 |
| 8,139,806 | B2 * | 3/2012 | Hosaka et al. | 381/373 |
| 2006/0050914 | A1 * | 3/2006 | Urso et al. | 381/328 |
| 2006/0137934 | A1 * | 6/2006 | Kurth | 181/135 |
| 2007/0183613 | A1 * | 8/2007 | Juneau et al. | 381/322 |
| 2008/0152163 | A1 * | 6/2008 | Mulvey | 381/74 |
| 2008/0170734 | A1 * | 7/2008 | Major et al. | 381/322 |
| 2008/0226114 | A1 * | 9/2008 | Thompson et al. | 381/380 |

* cited by examiner

*Primary Examiner* — Christopher Uhlir
(74) *Attorney, Agent, or Firm* — Creative Technology Ltd

(57) ABSTRACT

There is provided an insert ear bud earphone with variable noise isolation. The earphone includes a housing with a serpentine channel which is able to contain at least one transducer in a main body of the housing; and a cushion which contacts a user's ear canal wall, the cushion being mounted on the serpentine channel. There is preferably at least one opening in either the housing or the cushion which causes leakage and allows ambient noise to enter the user's ear canal. There is also provided a cushion for an insert ear bud earphone. Finally, there is provided a method to enable variable noise isolation in an insert ear bud earphone comprising an inclusion of at least one opening in either a housing of the earphone or a cushion mounted on the earphone which causes leakage and allows ambient noise to enter a user's ear canal.

15 Claims, 5 Drawing Sheets

EAR BUD EARPHONE WITH VARIABLE NOISE ISOLATION, A CUSHION FOR AN EAR BUD EARPHONE AND A CORRESPONDING METHOD

FIELD OF INVENTION

This invention relates to an ear bud earphone which is able to vary an extent of noise isolation and a cushion for use with the earphone. The invention also relates to a corresponding method to vary an extent of noise isolation.

BACKGROUND

Ear bud earphones which are inserted into users' ear canals during use have become increasingly popular for use with portable media devices and mobile phones. One of the reasons for the popularity of these earphones is because they are able to isolate the external noises which adversely affect the sounds emanating from the earphones.

However, it is for this reason that the use of such earphones is hazardous to the user under certain conditions. Such earphones are typically able to isolate noise within a certain bandwidth by more than 20 dB. When the user is using such earphones while jogging or cycling outdoors, this isolation may detrimentally reduce the user's awareness to ambient/environmental conditions, and this lack of awareness because of the noise isolation may lead to the safety of the user being compromised. For example, the user may be unaware that a vehicle is approaching or the user may take a longer than usual duration to react appropriately to the approach of a vehicle.

Despite the hazards mentioned earlier, many users still continue with the use of such earphones while exercising outdoors. This is because it has often become a habit which is difficult to break. Thus, there is a need to have earphones with adjustable isolation levels for use in different usage scenarios.

In addition, such insert earphones typically introduce "microphonic" noise which is generated from conduction of cables to our ear. This effect is also heard when there is conduction between our skulls and jaw during movement of the jaw. This "microphonic" noise may also be reduced with the use of earphones with adjustable isolation levels.

SUMMARY

In a first aspect, there is provided an insert ear bud earphone with variable noise isolation. The earphone includes a housing with a serpentine channel which is able to contain at least one transducer in a main body of the housing; and a cushion which contacts a user's ear canal wall, the cushion being mounted on the serpentine channel. There is preferably at least one opening in either the housing or the cushion which causes leakage and allows ambient noise to enter the user's ear canal.

The at least one opening in the housing may be on the serpentine channel, with a size of each of the at least one opening being variable by adjusting how the cushion is mounted on the serpentine channel. Alternatively, the at least one opening in the housing may be on the main body of the housing. It is advantageous that a size of each of the at least one opening is variable by using either a multi-stepped shutter or a plug. The cushion may be made from a material such as, for example, high density foam, silicone, rubber and the like.

In a second aspect, there is provided a cushion for an insert ear bud earphone. The cushion includes a first portion for contact with a user's ear canal wall; a second portion for mounting the cushion onto a housing of the earphone; a channel for transmission of audio signals from the earphone; and at least one opening. It is advantageous that the at least one opening causes leakage which allows ambient noise to enter the user's ear canal. The at least one opening may be located at either the first portion or the second portion. It is preferable that the cushion is mounted on a serpentine channel of the housing.

In a third aspect, there is provided a method to enable variable noise isolation in an insert ear bud earphone comprising an inclusion of at least one opening in either a housing of the earphone or a cushion mounted on the earphone which causes leakage and allows ambient noise to enter a user's ear canal.

Preferably, the at least one opening in the housing is on a serpentine channel of the housing, with a size of each of the at least one opening being variable by adjusting how the cushion is mounted on the serpentine channel.

Alternatively, the at least one opening in the housing is on the main body of the housing. A size of each of the at least one opening may be variable by using either a multi-stepped shutter or a plug. The cushion is preferably made from a material such as, for example, high density foam, silicone, rubber and the like. Preferably, the cushion contacts a user's ear canal wall to form an acoustic seal.

DESCRIPTION OF DRAWINGS

In order that the present invention may be fully understood and readily put into practical effect, there shall now be described by way of non-limitative example only preferred embodiments of the present invention, the description being with reference to the accompanying illustrative drawings.

DESCRIPTION OF PREFERRED EMBODIMENTS

Figure 3:
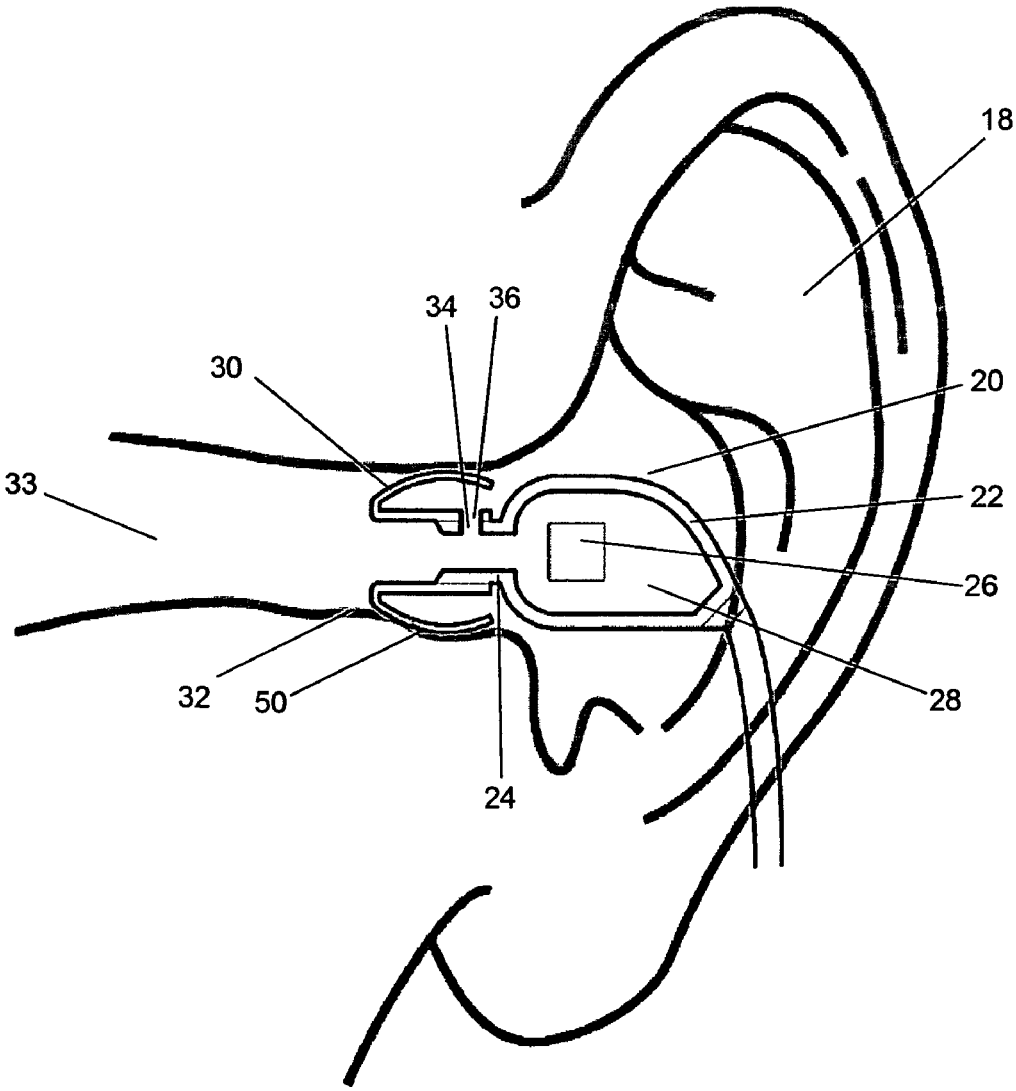
FIG. 3 shows a first embodiment of a cross-sectional view of an earphone of the present invention during use.

In a first aspect, there is provided an insert ear bud earphone 20 with variable noise isolation, with a cross sectional view of a first embodiment shown while in use in a user's ear 18 as depicted in FIG. 3. The earphone 20 includes a housing 22 with a serpentine channel 24 which is able to contain at least one transducer 26 in a main body 28 of the housing 22. Only one transducer 26 is shown in this embodiment. The earphone 20 may include a cushion 30 which contacts the user's ear canal 32 wall. The cushion 30 may be mounted on the serpentine channel 24 of the housing 22. At least one opening in either the housing 22 or the cushion 30 may cause leakage which allows ambient noise to enter the user's ear canal 33. The at least one opening will be described in further detail in subsequent portions of this section. A size of each of the at least one opening may be variable. Allowing ambient noise to enter the user's ear canal aids in improving safety of the user while the user is exercising outdoors.

Figure 2A:
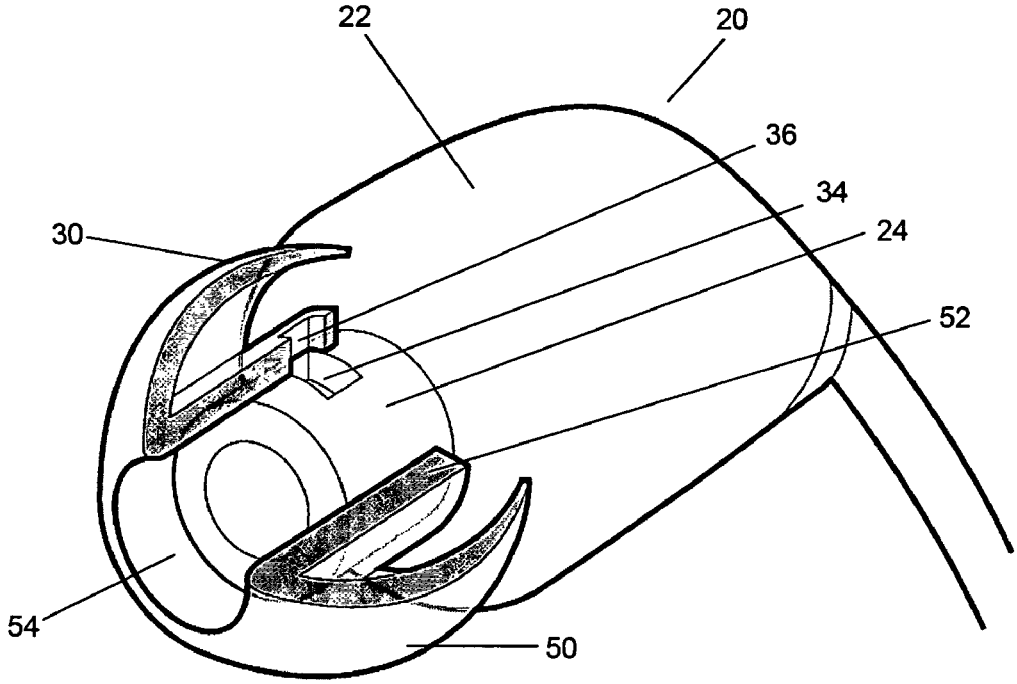
FIG. 2 shows a perspective cut-away view of the cushion.
Figure 2B:
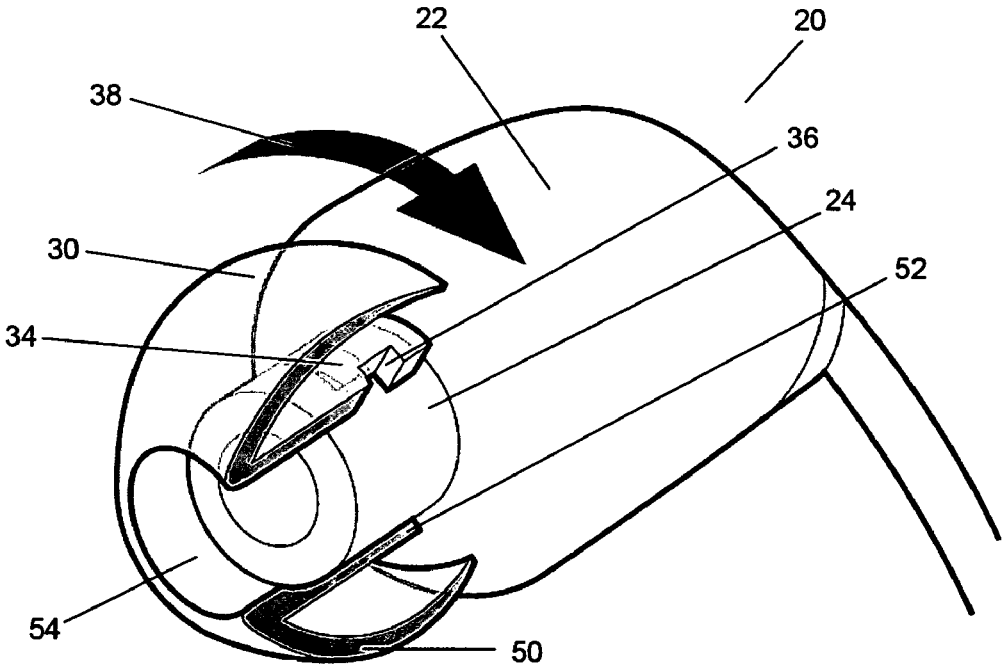

Referring to FIGS. 2 and 3, the at least one opening 34 in the housing 22 may be found on the serpentine channel 24. A size of each of the at least one opening 34 may be variable by adjusting how the cushion 30 (as depicted in FIGS. 2(*a*) and 2(*b*)) is mounted on the serpentine channel 24. In this instance, the cushion 30 includes opening(s) 36 at a portion of the cushion 30 which mounts onto the serpentine channel 24. The opening(s) 36 at a portion of the cushion 30 which mounts onto the serpentine channel 24 operate in conjunction with the at least one opening 34 on the serpentine channel 24 to enable ambient noise to enter the serpentine channel 24 and subsequently, the user's ear canal 33. In this embodiment, twisting 38 the cushion 30 in either a clock-wise (as shown in FIG. 2(*b*)) or anti clock-wise direction while the cushion 30 is mounted onto the serpentine channel 24 aids in enabling leakage from the housing 22 of the earphone 20. FIGS. 2(*a*) and 2(*b*) show how twisting 38 the cushion 30 enables the at least one opening 34 in the housing 22 to align with the opening(s) 36 at a portion of the cushion 30 which mounts onto the serpentine channel 24. The at least one opening 34 in the housing 22 and the opening(s) 36 need not be of the same size. The cushion 30 may be made from a material which is flexible and compressible such as, for example, high density foam, silicone, rubber and the like. Such materials are employed to enable the cushion 30 to form an acoustic seal with the user's ear canal 32 wall. Such materials should also have high coefficient of friction to prevent the user from removing the cushion 30 from the serpentine channel 24 when twisting 38 the cushion 30.

Figure 4A:
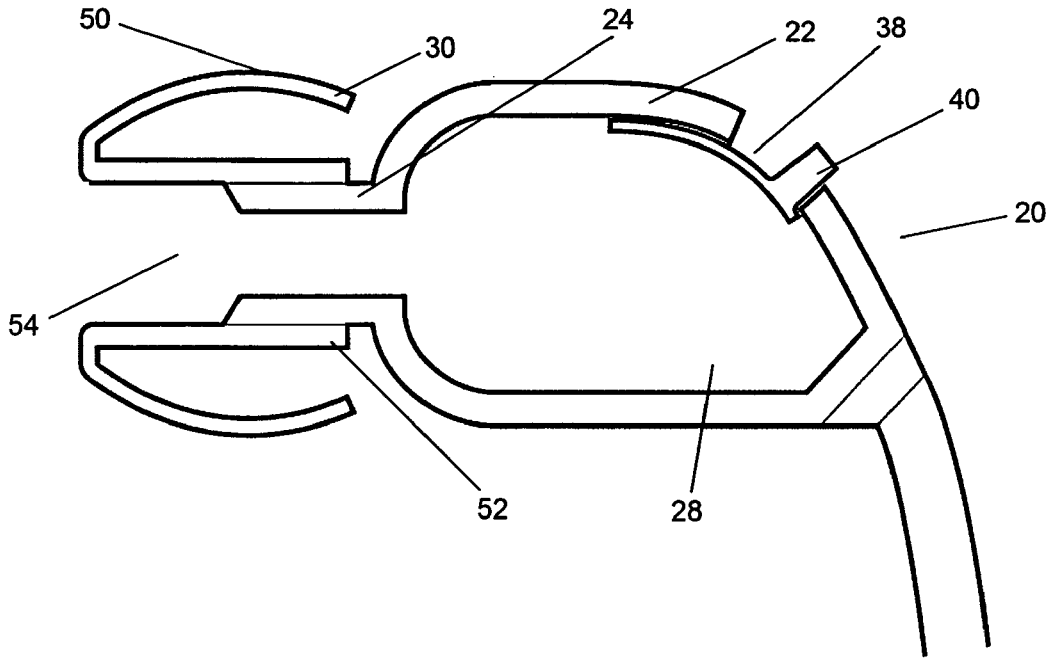
FIG. 4 shows a second embodiment of a cross-sectional view of a housing of the earphone of the present invention.
Figure 4B:
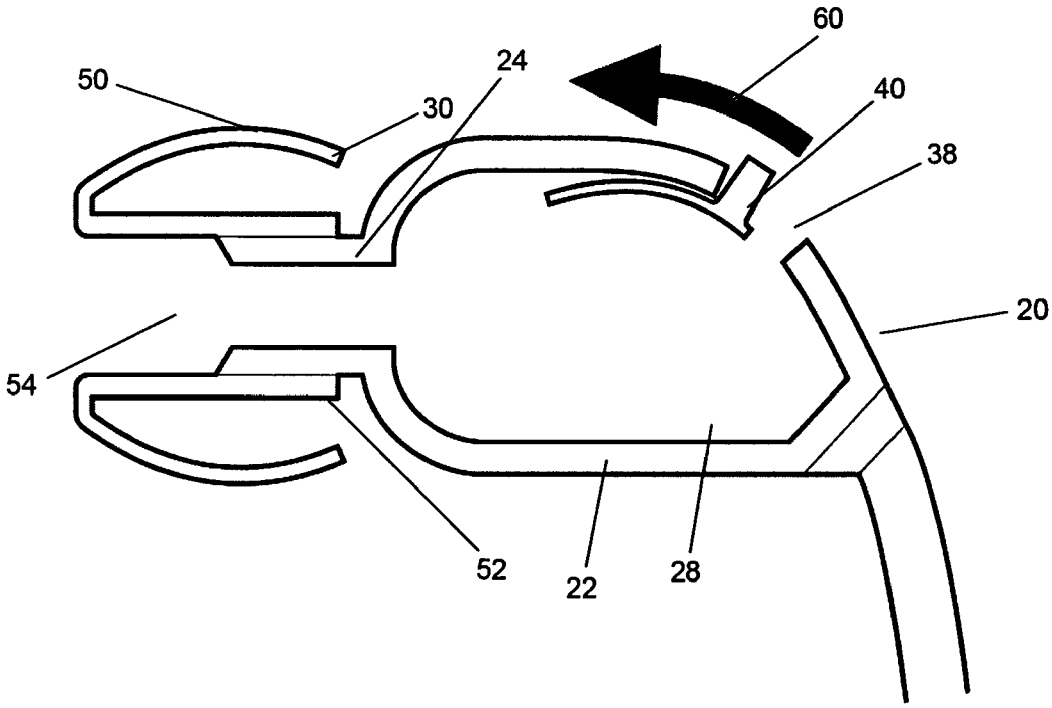

In a second embodiment as shown in FIGS. 4(*a*) and 4(*b*), the at least one opening 38 in the housing 22 may be on the main body 28 of the housing 22. The size of the at least one opening 38 may be varied using a multi-stepped shutter 40. The shutter 40 may be slidable (FIG. 4(*b*) shows the shutter 40 sliding upwards 60) and may reside at various locations to enable variation in the size of the at least one opening 38 besides configurations where the shutter 40 is fully closed or fully open. This enables control in relation to an extent of ambient noise entering the housing 22, and correspondingly, the user's ear canal 33.

Figure 5A:
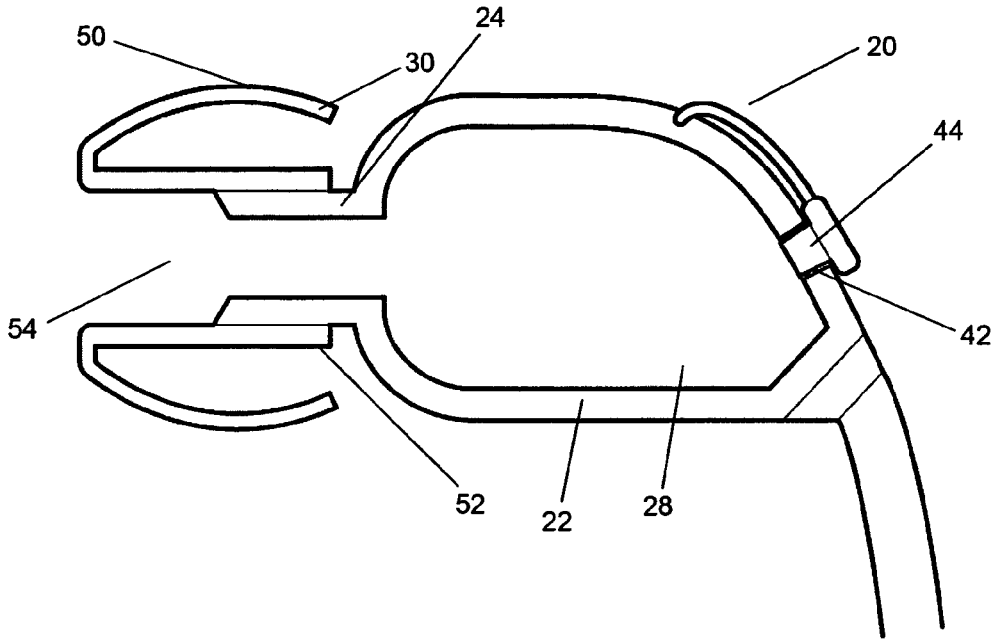
FIG. 5 shows a third embodiment of a cross-sectional view of a housing of the earphone of the present invention.
Figure 5B:
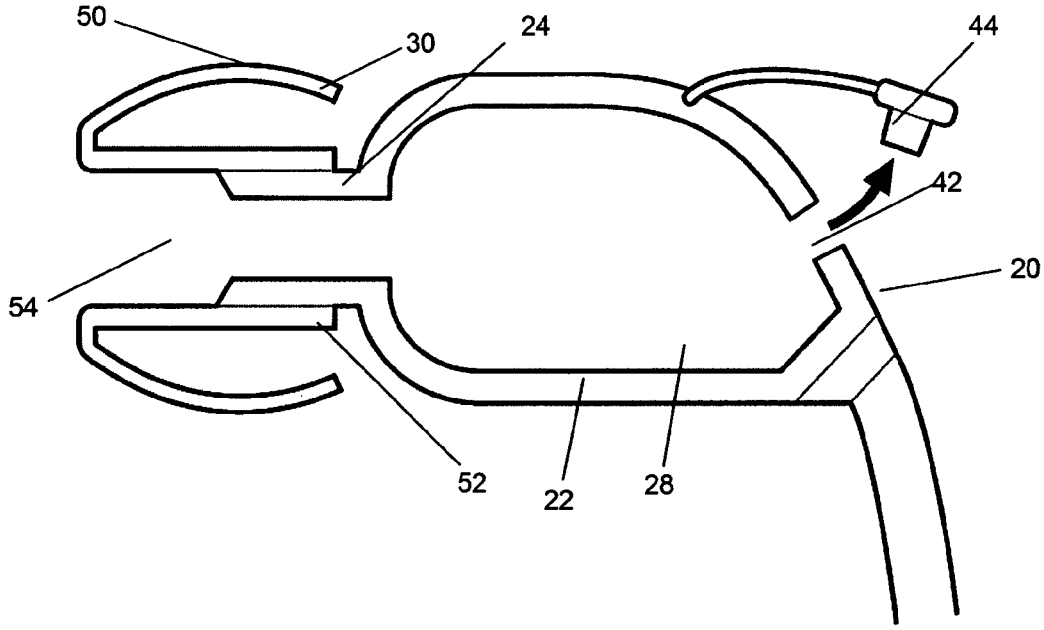

In a third embodiment as shown in FIGS. 5(*a*) and 5(*b*), the at least one opening 42 in the housing 22 may also be on the main body 28 of the housing 22. In this embodiment, the at least one opening 42 either allows ambient noise to enter the housing 22 or does not allow ambient noise to enter the housing 22. This is due to the use of a plug 44 with the at least one opening 42. FIG. 5(*a*) shows the plug 44 sealing the at least one opening 42 while FIG. 5(*b*) shows the removal of the plug 44 from the at least one opening 42. The plug 44 is preferably made from a flexible and compressible material which seals the at least one opening 42 in a manner which would not cause the plug 44 to be unplugged from the at least one opening 42 without intervention from the user.

Figure 1:
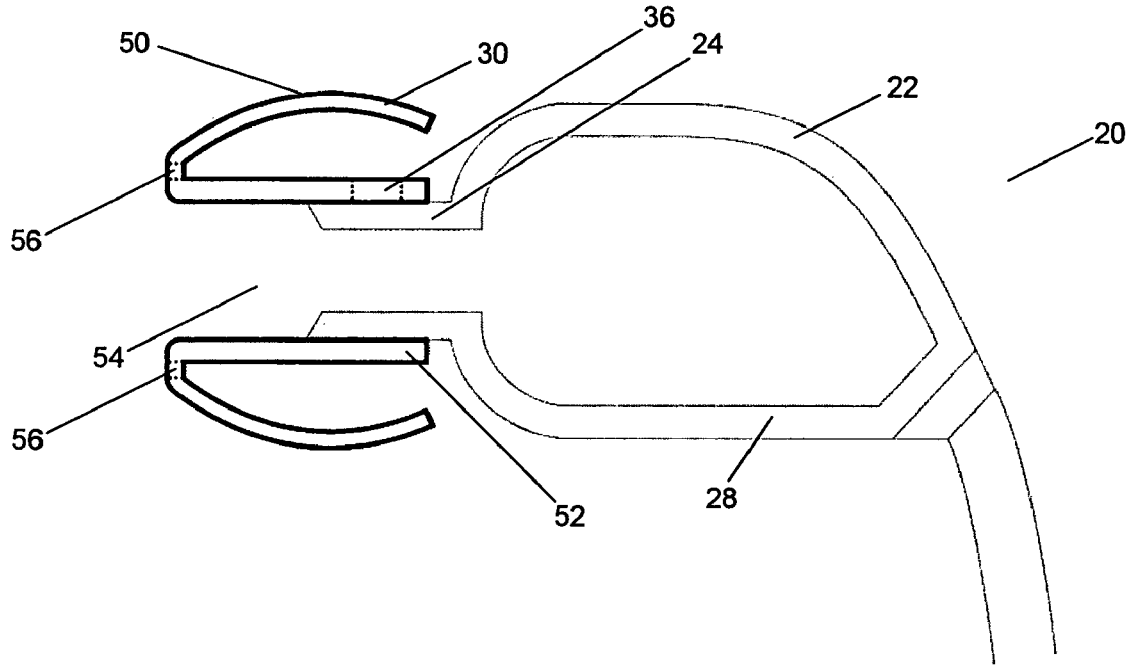
FIG. 1 shows a cross-sectional view of a cushion of the present invention.

In a second aspect, there is provided a cushion 30 for an insert ear bud earphone. A cross-sectional view of the cushion 30 is shown in FIG. 1 and a perspective cut-away view of a second portion of the cushion 30 is shown in FIGS. 2(*a*) and 2(*b*). It is preferable that the cushion 30 may be adaptable for use with all insert ear bud earphones. The cushion 30 may include a first portion 50 for contact with a user's ear canal 32 wall. A second portion 52 may be used for mounting the cushion 30 onto a housing of the earphone. It is preferable that the second portion 52 may be mounted on a serpentine channel of the housing. The cushion 30 may also include a channel 54 for transmission of audio signals from the earphone. The cushion 30 may also include at least one opening, where the at least one opening causes leakage and allows ambient noise to enter the user's ear canal 32.

The at least one opening 56 may be found in the first portion 50 of the cushion 30. Alternatively, the at least one opening 36 may be found in the second portion 52 of the cushion 30. The at least one opening 36 found in the second portion 52 of the cushion 30 may be used to enable leakage with openings found on the serpentine channel of the housing. This has been described in an earlier portion of this section.

In a third aspect, there is provided a method to enable variable noise isolation in an insert ear bud earphone comprising an inclusion of at least one opening in either a housing of the earphone or a cushion mounted on the earphone. Including the at least one opening causes leakage and allows ambient noise to enter a user's ear canal. In the method, the at least one opening in the housing may be on a serpentine channel of the housing, and a size of each of the at least one opening may be variable by adjusting how the cushion is mounted on the serpentine channel. Using the cushion to vary the size of the at least one opening has been described in an earlier portion of this section.

In the method, when the at least one opening in the housing is on the main body of the housing, a size of each of the at least one opening being variable by using a multi-stepped shutter. The shutter may be slidable and may reside at various locations to enable variation in the size of the at least one opening. This enables control in relation to an extent of ambient noise entering the housing, and correspondingly, the user's ear canal. Alternatively, instead of the shutter, a plug may also be used to enable an "open-and-shut" type of opening in the housing. However, the size of the opening is not variable when using the plug.

In the method, it is preferable that the cushion may be made from a material which is flexible and compressible such as, for example, high density foam, silicone, rubber and the like. Such materials are employed to enable the cushion to form an acoustic seal with the user's ear canal wall. Such materials should also have high coefficient of friction to prevent the user from removing the cushion from the serpentine channel when twisting the cushion to vary an extent of noise isolation offered by the earphones.

Whilst there has been described in the foregoing description preferred embodiments of the present invention, it will be understood by those skilled in the technology concerned that many variations or modifications in details of design or construction may be made without departing from the present invention.

The invention claimed is:

1. An insert ear bud earphone with variable noise isolation, the earphone including:

a housing with a serpentine channel which is able to contain at least one transducer in a main body of the housing; and a cushion which contacts a user's ear canal wall, the cushion being mounted on the serpentine channel, wherein at least one opening in either the housing or the cushion causes leakage which allows ambient noise to enter the user's ear canal, and wherein the at least one opening in the housing is on the serpentine channel, with a size of each of the at least one opening being variable by adjusting how the cushion is mounted on the serpentine channel.

2. The earphone of claim 1, wherein the at least one opening in the housing is on the main body of the housing.

3. The earphone of claim 2, wherein a size of each of the at least one opening being variable.

4. The earphone of claim 3, wherein the size of each of the at least one opening is variable using a multi-stepped shutter.

5. The earphone of claim 3, wherein the size of each of the at least one opening is variable using a plug.

6. The earphone of claim 1, wherein the cushion is made from a material selected from the group consisting of: high density foam, silicone, and rubber.

7. A cushion for an insert ear bud earphone, the cushion including:

a first portion for contact with a user's ear canal wall;

a second portion for mounting the cushion onto a housing of the earphone, the housing having at least one opening;

a channel for transmission of audio signals from the earphone; and at least one opening, wherein the at least one opening in either the housing or the cushion causes leakage which allows ambient noise to enter the user's ear canal, wherein the cushion is mountable on a serpentine channel of the housing, and wherein the at least one opening in the housing is on the serpentine channel, with a size of each of the at least one opening being variable by adjusting how the cushion is mounted on the serpentine channel.

8. The cushion of claim 7, wherein the at least one opening is located at either the first portion or the second portion.

9. A method to enable variable noise isolation in an insert ear bud earphone comprising:

an inclusion of at least one opening in either a housing of the earphone or a cushion mounted on the earphone which causes leakage and allows ambient noise to enter a user's ear canal, wherein the at least one opening in the housing is on a serpentine channel of the housing, with a size of each of the at least one opening being variable by adjusting how the cushion is mounted on the serpentine channel.

10. The method of claim 9, wherein the at least one opening in the housing is on the main body of the housing.

11. The method of claim 10, wherein a size of each of the at least one opening is variable.

12. The method of claim 11, wherein the size of each of the at least one opening is variable using a multi-stepped shutter.

13. The method of claim 11, wherein the size of each of the at least one opening is variable using a plug.

14. The method of claim 9, wherein the cushion is made from a material selected from the group consisting of: high density foam, silicone, and rubber.

15. The method of claim 14, wherein the cushion contacts a user's ear canal wall to form an acoustic seal.

* * * * *